United States Patent [19]

Davis

[11] Patent Number: 4,708,248

[45] Date of Patent: Nov. 24, 1987

[54] COLLAPSIBLE FOOD AND BEVERAGE CONTAINER

[76] Inventor: George H. Davis, Rte. 3, Raleigh, N.C. 27603

[21] Appl. No.: 827,862

[22] Filed: Feb. 10, 1986

[51] Int. Cl.[4] ..... A45C 11/20

[52] U.S. Cl. ..... 206/549; 206/548; 229/87 F; 383/38; 426/120

[58] Field of Search ..... 206/541, 549, 217, 499, 206/427, 434, 813, 815, 548; 229/87 F; 383/38-40, 127, 10, 7; 426/110, 119, 120; 220/DIG. 10

[56] References Cited

U.S. PATENT DOCUMENTS

| | | | |
|---|---|---|---|
| 317,762 | 5/1885 | Gill | 206/541 |
| 1,139,128 | 5/1915 | Lindberg | 383/7 X |
| 1,158,349 | 10/1915 | Whalen | 383/127 |
| 1,288,290 | 12/1918 | Thrasher | 383/84 |
| 1,456,897 | 5/1923 | McGrath | 383/38 |
| 1,693,622 | 12/1928 | Spaulding | 206/815 X |
| 1,726,740 | 9/1929 | Joffe | 383/10 X |
| 1,935,307 | 11/1933 | Ackerman | 206/541 |
| 2,112,406 | 3/1938 | Metro | 383/38 |
| 2,238,545 | 4/1941 | Whiley | 206/427 |
| 2,615,563 | 10/1952 | Sundberg et al. | 206/541 |
| 2,861,735 | 11/1958 | Faltin | 383/62 X |
| 3,420,433 | 1/1969 | Bostwick | 383/62 X |
| 3,640,380 | 2/1972 | Huffman | 206/549 |
| 3,815,967 | 6/1974 | Jocelyn | 206/815 X |

*Primary Examiner*—Stephen Marcus
*Assistant Examiner*—Bryon Gehman

[57] ABSTRACT

This invention relates to food containers in the form of paper or plastic bag like structures having interiorly deployable food and beverage support means. These containers can be shipped in compact, folded condition resembling a plain bag but when opened and the support means deployed, a sturdy, secure beverage and food carrier is provided.

12 Claims, 8 Drawing Figures

COLLAPSIBLE FOOD AND BEVERAGE CONTAINER

FIELD OF INVENTION

This invention relates to containers and more particularly to container means designed for use in conjunction with the carrying of foods and/or beverages.

BACKGROUND OF INVENTION

With the advent of fast food type establishments there has been a problem with take-out orders. Paper bags have been used but the drinks often at least partially tip over leaking on adjacent food as well as weakening the bottom of the bag.

To overcome this problem, tray type cartons have been designed which are usually made of cardboard or the like and are shipped in flat condition and thereafter folded open to accept a bag of food in the center thereof with a plurality of drink holders on either side. These trays or cartons are relatively flimsy and easily bend, causing the drinks to spill. Additionally they are hard to carry and require both hands of the person. A juggling act usually ensues when such person tries to leave the restaurant, open his or her car door, or the like.

The separate bag for food and carton for drinks greatly adds to the overhead costs of the fast food establishment and, as pointed out above, give questionable to unsatisfactory results. Further there is twice as much trash to dispose of which, unfortunately, quite often ends up on the side of the road.

After much research and study into the above mentioned problems, the present invention has been developed to provide a bag-like container with an interiorly deployable support means which allows drinks to be held in an upright position in the lower portion thereof with the food being supported on a separate, deployable member to prevent any possibility of liquid contanmination of the food as well as giving rigidity to the overall container.

The above is accomplished through the provision of relatively stiff support means secured to and mounted within a bag type container and including somewhat weaked fold lines. The support means do not interfere with the bag being folded in the normal manner.

When the bag is ready to use it is opened in the normal manner. The first support means is folded down along predetermined fold lines and is adapted to supportingly receive a drink container or containers. A second support means is then folded into place to support food products as well as to separate such products from said drink or drinks. The top of the bag is then closed and can be transported without fear of the drinks turning over, the food becoming contaminated with the liquids, nor the contents of the bag undesirably shifting.

In addition to the bag advantages, the present invention is also less expensive to produce than separate bags and separate support means, is easier to ship and store than two separate items, is more convenient to use, and is adaptable to be used in conjunction with different standard size drink containers.

In view of the above, it is an object of the present invention to provide an internally deployable, beverage and food support means.

Another object of the present invention is to provide an improved food type container including built in beverage and food support means.

Another object of the present invention is to provide a bag type container with box type support means provided therein.

Another object of the present invention is to provide an improved food container having separate support means for beverages and food.

Another object of the present invention is to provide a bag type container having separate support means deployable interiorly thereof for supporting beverages and food.

Other objects and advantages of the present invention will become apparent and obvious from study of the following description and the accompanying drawings which are merely illustrative of such invention.

BRIEF DESCRIPTION OF INVENTION

DETAILED DESCRIPTION OF INVENTION

With further reference to the drawings, the improved container of the present invention, indicated generally at 10, includes a bag portion 11, a drink support portion 12, and a food support portion 13.

Figure 1:
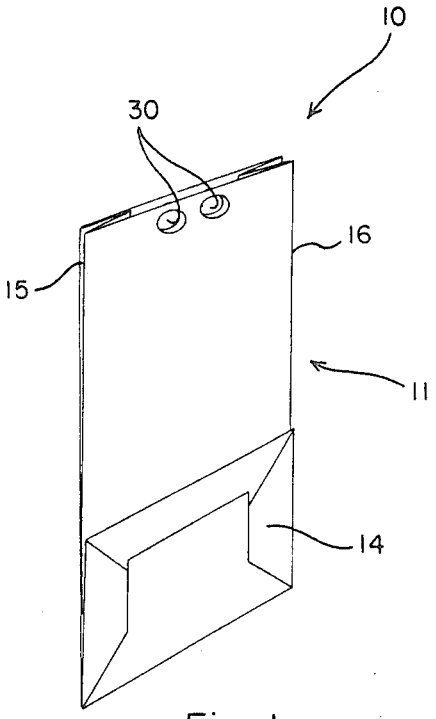
FIG. 1 is a perspective view of the improved container of the present invention in folded, shipping and storage position.
Figure 5:
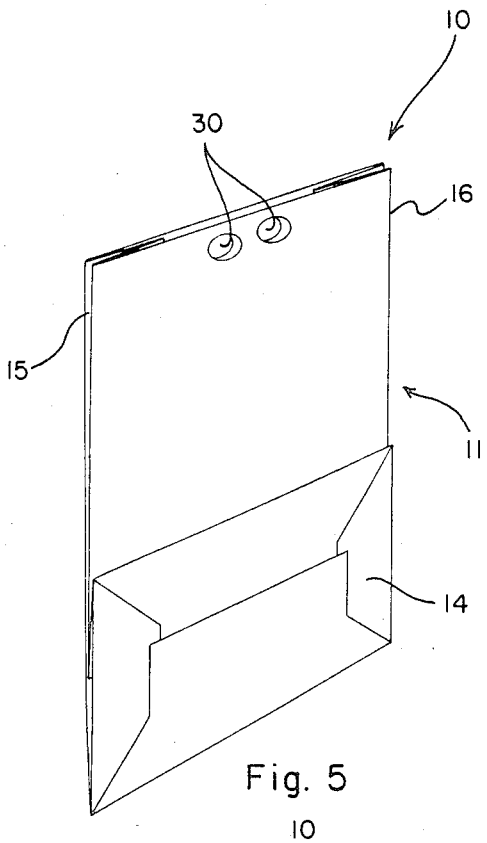
FIG. 5 is a perspective view of a modified container in folded, shipping and storage configuration.

The bag portion 11 is preferably a standard configured and constructed paper bag and can be folded flat for shipment and storage as seen clearly in FIGS. 1 and 5. Said bag portion 11 includes a bottom 14, inwardly foldable sidewalls 15 and 16, a foldable front wall 17, and a non-foldable rear wall 18. Bags of this type and the manner of folding such bags is well known to those skilled in the art, can clearly be seen in the Figures, and further detailed discussion of the same is not deemed necessary.

Figure 2:
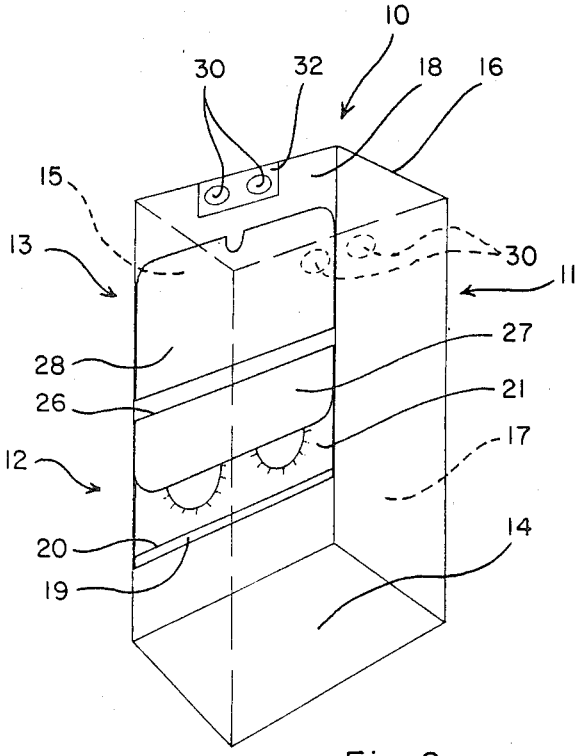
FIG. 2 is a perspective view of such container as it is first opened.
Figure 4:
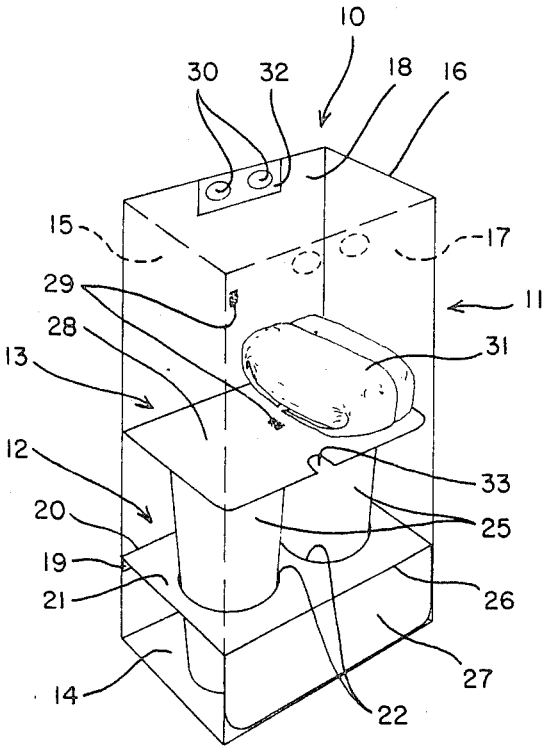
FIG. 4 is a perspective view of both the beverage support means and the food support means operatively deployed within the container of the present invention.
Figure 6:
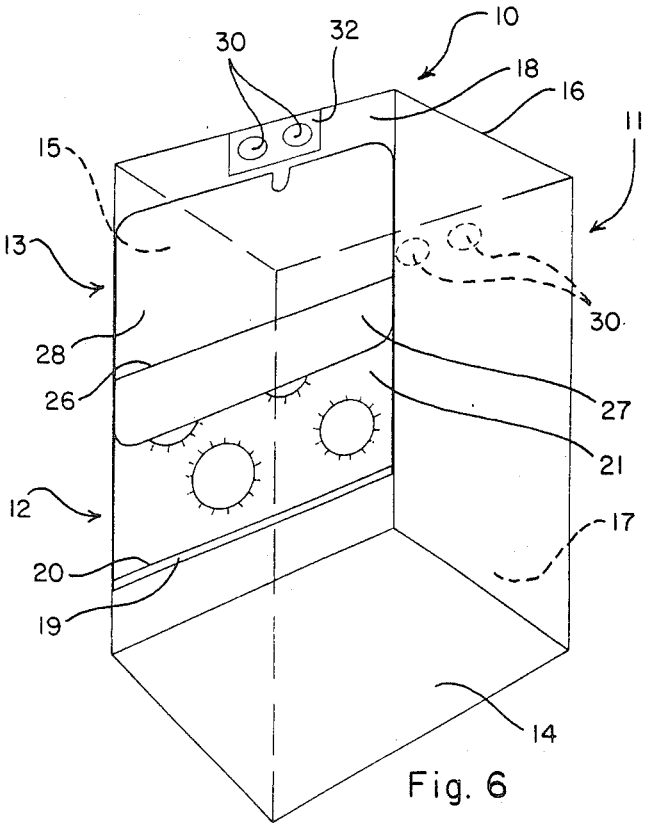
FIG. 6 is a perspective view of such modification with the container opened.
Figure 7:
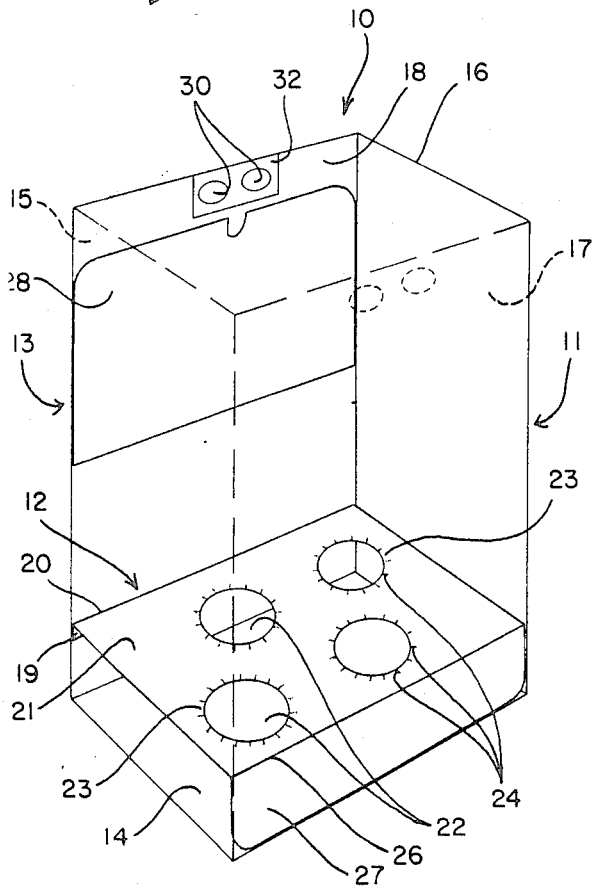
FIG. 7 is a perspective view of the modification with the beverage support deployed.
Figure 8:
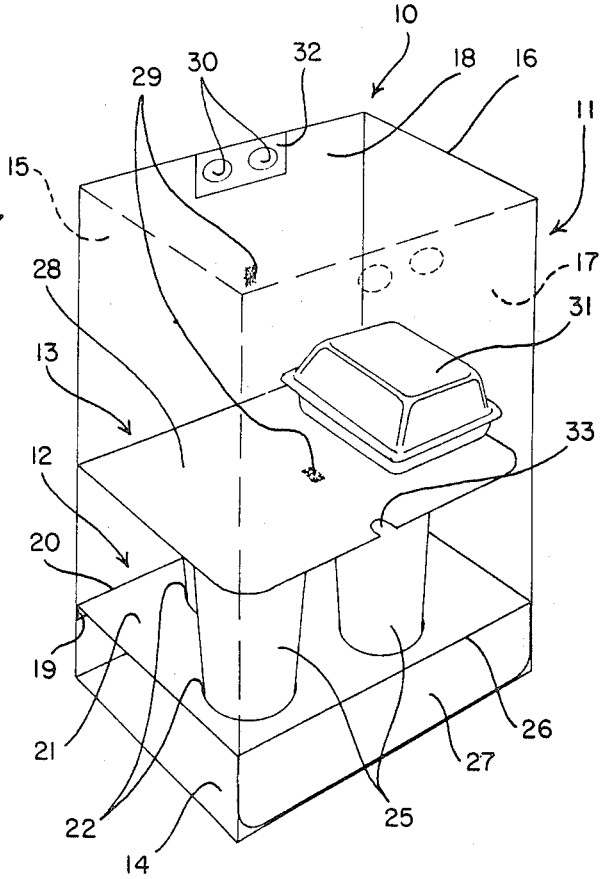
FIG. 8 is a perspective view of such modification with both the beverage support and food support means deployed and in transport configuration.

The drink support portion 12 of the present invention includes a lip area 19 which is glued or otherwise secured the interior of rear wall 18 in spaced relation with bottom 14. A fold line 20 is provided which separates support lip 19 from drink insert portion 20 so that said portion can be disposed as seen in FIGS. 2 and 6 during storage and shipment, and can be folded to a plane parallel to bottom 14 when in use as seen in FIGS. 3 and 4, and 7 and 8.

A plurality of drink cup openings 22 are provided in drink insert portion 21. The peripheral area 23 of each of the drink openings 22 are either slotted or weakened as indicated at 24. Thus each of said drink openings can engagingly support a variety of different sizes of drink cups 25 with the slotted or weakened areas 24 allowing such peripheral area to readily expand to accept the larger size cup.

Along the edge of drink insert portion 21, opposite fold line 20, is a fold line 26. Support flap 27 is attached to drink insert portion 21 by fold line 26. In the stored condition, support flap 27 is folded back juxtaposed to the underside of insert portion 21 as can clearly be seen in FIGS. 2 and 6. During use, as will hereinafter be set forth in greater detail, support flap 27 is folded outwardly 90 degrees to the position shown in FIGS. 3 and 4, and 7 and 8.

The food support portion 12 of the present invention is in the form of a flat sheet of cardboard, plastic or the like and is indicated at 28. To maintain support sheet 28 in the desired location juxtaposed to rear wall 18 during shipment, storage, and prior to use, and to insure that the same is readily available for use, it can be temporarily attached to said rear wall 18 of bag portion 11 by means such as an adhesive 29. This adhesive can be either glue or any other suitable temporary securing material or means.

To use the improved container 10 of the present invention, the same is shipped in folded, collapsed condition as shown in FIGS. 1 and 5.

When a take-out order has been received, the bag is unfolded and opened in the normal manner as shown in FIGS. 2 and 6. Since support lip 19 is secured to the rear wall 18 of the bag portion 11 and the support sheet 28 is also adhered to such wall, these two supports will remain juxtaposed to said rear wall.

Figure 3:
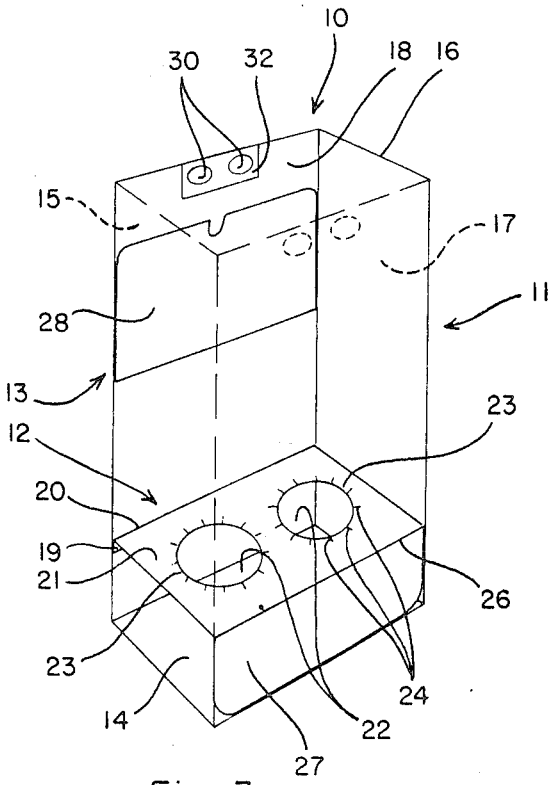
FIG. 3 is a perspective view of such container with the drink support means deployed.

Next, flap 27 is folded outwardly 90 degrees along fold line 20 from the position shown in FIG. 2 to the position shown in FIG. 3. At the same time the drink insert 21 is folded outwardly 90 degrees along fold line 20.

The drink cups 25 ordered by the customer can now be placed in drink cup openings 22 so that they rest on bottom of 14 of bag portion 11. Such drinks will be held in upright position by the drink cup insert 21 because it extends all the way across the bag from side wall 15 to side wall 16 and from front wall 17 to rear wall 18 as well as being supported by lip 19 and support flap 27.

After the drinks have been disposed as hereinabove described, support sheet 28 can be grasped and the adhesive bond 29 holding the same to rear wall 18 separated. Such support sheet can then be rested on top of the drink cups 25 to form a flat horizontal surface as clearly seen in FIGS. 4 and 8. The food 31 the customer has ordered can then be placed on support 28 and will be separated and isolated from the drinks thereunder.

The upper portions of side walls 15 and 16 can then be folded inwardly thereby bringing the upper portion of front wall 17 and rear wall 18 together. Since handle openings 30 area reinforced by means such as plastic sheeting bonded to the interior of the respective front and rear walls, such openings 30 can be used as a handle to carry the improved container 10 of the present invention.

Once the food and beverages or other contents have been carried to their desired location, the top of the bag portion 11 can again be opened, and the food 31 removed from support 28. The finger hole 33 in support 28 allows said support sheet to be easily removed thus giving ready access to the drink cups 25 supported by the drink support portion 12 of the present invention.

The primary difference between the improved container 10 shown in FIGS. 1 through 4 and the modification thereof shown in FIGS. 5 through 8 is that the former is for small orders while the latter is for larger orders. It is to be understood, of course, that larger or smaller containers could be provided utilizing the present invention.

Although fast food stores now use paper bags almost exclusively, it is to be understood that bags made from plastic or other suitable materials can be used.

It is obvious from the above that the present invention provides a relatively inexpensive and yet highly efficient container which supports drinks as well as food in separated compartments without requiring additional structure to be associated therewith. Also, during shipment and storage, the invention can be folded in a flat, space saving configuration.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A container for food and beverage type products comprising: a foldable, bag-like structure including a bottom, an upstanding wall structure, and an open top; a first deployable support means disposed interiorly of said bag-like structure and including at least one aperture for receiving and supporting a beverage type container, the border of said aperture being weakened so as to frictionally engage a variety of different size beverage containers, said first support means being hingedly secured along one edge thereof to said upstanding wall structure so as to be movable between a folded position in which said first support means extends in the direction of said upstanding wall structure and a deployed position in which said first support means extends substantially parallel to said bottom of said bag-like structure; a support flap hingedly secured along an edge of said first support means for engaging said bottom of said bag-like structure when said first support means assumes a deployed position and supporting said first support means in parallel spaced relationship to said bottom of said bag-like structure when said beverage containers are inserted into said apertures; a second support means disposed interiorly of said bag-like structure above and in spaced relation with said first support means, said second support means being hingedly secured along one edge thereof to said upstanding wall structure so as to be movable between a folded position in which said second support means extends in the direction of said upstanding wall structure and a deployed position in which said second support means extends substantially parallel to said bottom of said bag-like structure; and adhesive means for holding at least one of said first and second support means in its folded position.

2. The container of claim 1 wherein said foldable bag-like structure is a foldable paper bag.

3. The container of claim 1 wherein said foldable bag-like structure is formed from a plastic type material.

4. The container of claim 1 wherein said first support means includes means for supporting a plurality of beverage type containers.

5. The container of claim 1 wherein said second support means is a sheet like structure.

6. The container of claim 1 wherein said second support means includes a finger hole to allow said second support means to be easily moved.

7. The container of claim 1 wherein said first support means is formed from cardboard type material.

8. The container of claim 1 wherein said second support means is formed from cardboard type material.

9. The container of claim 1 wherein said second support means is formed from sheet plastic type material.

10. The container of claim 1 wherein a handle means is provided for carrying said bag-like structure.

11. The container of claim 10 wherein said handle means is in the form of finger openings formed in the upper portion of said bag-like structure.

12. The container of claim 11 wherein said finger openings are reinforced.

* * * * *